US007273104B2

(12) United States Patent
Wilkinson

(10) Patent No.: US 7,273,104 B2
(45) Date of Patent: Sep. 25, 2007

(54) METHOD OF PUMPING AN "IN-THE-FORMATION" DIVERTING AGENT IN A LATERAL SECTION OF AN OIL AND GAS WELL

(75) Inventor: Jeffery M Wilkinson, Bedford, TX (US)

(73) Assignee: Key Energy Services, Inc., New Hope, PA (US)

( * ) Notice: Subject to any disclaimer, the term of this patent is extended or adjusted under 35 U.S.C. 154(b) by 0 days.

(21) Appl. No.: 11/161,185

(22) Filed: Jul. 26, 2005

(65) Prior Publication Data

US 2006/0021753 A1 Feb. 2, 2006

Related U.S. Application Data

(60) Provisional application No. 60/593,032, filed on Jul. 30, 2004.

(51) Int. Cl.
*E21B 43/26* (2006.01)

(52) U.S. Cl. ..... 166/305.1; 166/308.1

(58) Field of Classification Search ..... 166/305.1, 166/308.1

See application file for complete search history.

(56) References Cited

U.S. PATENT DOCUMENTS 4,102,401 A 7/1978 Erbstoesser et al.
4,139,060 A 2/1979 Mueche et al.
4,160,482 A 7/1979 Erbstoesser et al.
4,287,952 A 9/1981 Erbstoesser
4,407,368 A 10/1983 Erbstoesser
4,410,387 A 10/1983 Halkerston et al.
4,421,167 A 12/1983 Erbstoesser et al.
4,505,334 A 3/1985 Doner et al.
4,702,316 A 10/1987 Chung et al.
4,753,295 A 6/1988 Gabriel et al.
4,881,599 A 11/1989 Franco et al.
5,309,995 A 5/1994 Gonzalez et al.
5,351,533 A 10/1994 Macadam et al.
5,485,882 A 1/1996 Bailey et al.
5,497,831 A 3/1996 Hainey et al.
5,890,536 A 4/1999 Nierode et al.
6,116,340 A 9/2000 Wilson et al.
6,186,230 B1 2/2001 Nierode
6,367,548 B1 * 4/2002 Purvis et al. ..... 166/281

(Continued)

*Primary Examiner*—Kenneth Thompson
*Assistant Examiner*—Giovanna M Collins
(74) *Attorney, Agent, or Firm*—Wong, Cabello, Lutsch, Rutherford, & Brucculeri, LLP

(57) ABSTRACT

A method of treating a formation at a lateral section of a well involves pumping treatment fluid with or without a proppant, such as sand slugs, into the well to induce fractures in the formation. The lateral section has openings in a casing, which can be un-cemented. The treatment fluid is pumped into the well to treat portions of the formation at the heel and toe of the lateral section without mechanically dividing the lateral section of the well. A concentration of degradable diverting agent is mixed with the treatment fluid, and the treatment fluid with agent is pumped into the well. The agent is pumped into the portions of the formation having the lowest fracture gradient, such as near the heel and toe of the lateral section. The pumped fluid is at least diverted from the heel and toe of the lateral section by the agent so that portions of the formation adjacent the middle portion of the lateral section can be treated the pumped fluid.

25 Claims, 7 Drawing Sheets

U.S. PATENT DOCUMENTS 6,380,138 B1 4/2002 Ischy et al.
6,394,184 B2 * 5/2002 Tolman et al. ..... 166/281
6,412,561 B1 7/2002 Brown et al.
6,575,247 B2 6/2003 Tolman et al.
6,644,406 B1 11/2003 Jones
2003/0010498 A1 1/2003 Tolman et al.

* cited by examiner

End of Pad
*Pump Schedule*

Rate (bpm): 140 Est. Pressure (psi): 5000

| Stage | Gallons | Fluid Type/Prop Mesh/Type | Rate (bpm) | Prop/ Stage | Slurry Bbls. | Stage Time |
|---|---|---|---|---|---|---|
| | | Pump via 5-1/2" Casing at Best Rate Possible.<br><br>Maximum Pressure is 6000 psi. | | | | |
| **Barnett Shale** | | | | | | |
| Load Hole | 15,000 | Treated Water | 60 | | 357.1 | 6.0 |
| Pad | 80,000 | Treated Water | 130 | | 1,904.8 | 14.7 |
| StepDown/ISIP | 0 | Take ISIP and Figure Holes Open | 0 | | 0.0 | *5.0* |
| Pad | 400,000 | Treated Water | 130 | | 9,523.8 | 73.3 |
| Pad | 30,000 | Treated Water + **Slugs of 40/70 Ottawa** | 130 | *63000* | 714.3 | 5.5 |
| Pad | 80,000 | Treated Water + **Slug of Biodegradable Diverting Agent** | 130 | | 1,904.8 | 14.7 |
| 0.20 | 127,500 | Treated Water + 40/70 Ottawa | 140 | 25500 | 3,063.4 | 21.9 |
| 0.30 | 195,000 | Treated Water + 40/70 Ottawa | 140 | 58500 | 4,706.4 | 33.6 |
| 0.40 | 270,000 | Treated Water + 40/70 Ottawa | 140 | 108000 | 6,545.8 | 46.8 |
| 0.50 | 390,000 | Treated Water + 40/70 Ottawa | 140 | 195000 | 9,497.4 | 67.8 |
| 0.60 | 450,000 | Treated Water + 40/70 Ottawa | 140 | 270000 | 11,007.4 | 78.6 |
| 0.40 | 105,000 | Treated Water + 20/40 Ottawa | 140 | 42000 | 2,545.6 | 18.2 |
| 0.45 | 150,000 | Treated Water + 20/40 Ottawa | 140 | 67500 | 3,644.7 | 26.0 |
| 0.50 | 180,000 | Treated Water + 20/40 Ottawa | 140 | 90000 | 4,383.4 | 31.3 |
| 0.75 | 30,000 | Treated Water + 20/40 Ottawa | 140 | 22500 | 738.7 | 5.3 |
| OverFlush | 9,000 | Treated Water | 140 | | 214.3 | 1.5 |
| Cum. Totals | 2,511,500 | | | 942,000 | 60,752 | 450 |

*FIG. 4A*

"Type B" Un-cemented
Horizontal in Mid-Sand
*Pump Schedule*

Rate (bpm): 125 - 130 Est. Pressure (psi): 5100

| Stage | Gallons | Fluid Type/Prop Mesh/Type | Rate (bpm) | Prop/ Stage | Slurry Bbls. | Stage Time |
|---|---|---|---|---|---|---|
| | | **Pump via 5-1/2" Casing at Best Rate Possible.** **Maximum Pressure is 6000 psi.** **Test Lines to 6500 psi.** | | | | |
| **Barnett Shale** | | | | | | |
| Load Hole | 15,000 | Treated Water | 60 | | 357.1 | 6.0 |
| Pad | 80,000 | Treated Water | 125 | | 1,904.8 | 15.2 |
| StepDown/ISIP | 0 | Take ISIP and Figure Holes Open | 0 | | 0.0 | *5.0* |
| Pad | 360,000 | Treated Water | 125 | | 8,571.4 | 68.6 |
| Sand Slugs | 30,000 | Treated Water + **Slugs of 40/70 Ottawa** | 125 | 5000 | 714.3 | 5.7 |
| 0.20 | 65,000 | Treated Water + 40/70 Ottawa | 130 | 13000 | 1,561.7 | 12.0 |
| 0.30 | 105,000 | Treated Water + 40/70 Ottawa | 130 | 31500 | 2,534.2 | 19.5 |
| 0.40 | 140,000 | Treated Water + 40/70 Ottawa | 130 | 56000 | 3,394.1 | 26.1 |
| 0.50 | 200,000 | Treated Water + 40/70 Ottawa | 130 | 100000 | 4,870.5 | 37.5 |
| 0.60 | 70,000 | Treated Water + 40/70 Ottawa | 130 | 42000 | 1,712.3 | 13.2 |
| Pad | 9,000 | Treated Water + **Slug of Biodegradable Diverting Agent** | 130 | | 214.3 | 1.6 |
| 0.60 | 200,000 | Treated Water + 40/70 Ottawa | 130 | 120000 | 4,892.2 | 37.6 |
| 0.40 | 65,000 | Treated Water + 20/40 Ottawa | 130 | 26000 | 1,575.8 | 12.1 |
| 0.45 | 70,000 | Treated Water + 20/40 Ottawa | 130 | 31500 | 1,700.9 | 13.1 |
| 0.50 | 100,000 | Treated Water + 20/40 Ottawa | 130 | 50000 | 2,435.2 | 18.7 |
| 0.75 | 20,000 | Treated Water + 20/40 Ottawa | 130 | 15000 | 492.5 | 3.8 |
| OverFlush | 10,500 | Treated Water | 130 | | 250.0 | 1.9 |
| | | **Record ISDP, 5, 10, & 15 minute pressures. Rig down, Prepare for 2nd Stage. Set Composite Plug @ 8,830'.** | | | | |
| Cum. Totals | 1,539,500 | | | 490,000 | 37,181 | 298 |

*FIG. 5A*

METHOD OF PUMPING AN "IN-THE-FORMATION" DIVERTING AGENT IN A LATERAL SECTION OF AN OIL AND GAS WELL

CROSS-REFERENCE TO RELATED APPLICATIONS

This is a non-provisional of U.S. Provisional Application Ser. No. 60/593,032 filed Jul. 30, 2004, which is incorporated herein by reference and to which priority is claimed.

FIELD OF THE DISCLOSURE

The subject matter of the present disclosure generally relates to a method of treating formations in oil or gas wells and more particularly relates to a method of pumping "in-the-formation" diverting agent in oil or gas wells to treat a lateral section of a horizontal well.

BACKGROUND OF THE DISCLOSURE

Oil and gas wells are typically constructed with a string of pipe, known as casing or tubing, in the well bore and concrete around the outside of the casing to isolate the various formations that are penetrated by the well. At the strata or formations where hydrocarbons are anticipated, the well operator perforates the casing to allow for the flow of oil and/or gas into the casing and to the surface.

At various times during the life of the well, it may be desirable to increase the production rate of hydrocarbons with stimulation by acid treatment or hydraulic fracturing of the hydrocarbon-producing formations surrounding the well. In a hydraulic fracturing operation, a fluid such as water which contains particulate matter such as sand, is pumped down from the surface into the casing and out through the perforations into the surrounding target formation. The combination of the fluid rate and pressure initiate cracks or fractures in the rock. The particulates lodge into these fractures in the target formation and serve to hold the cracks open. The increased openings thus increase the permeability of the formation and increase the ability of the hydrocarbons to flow from the formation into the well casing after the fracture treatment is completed.

Within a given formation, the fracture gradient is the pressure or force needed to initiate a fracture in the formation by way of pumping a fluid at any rate. The fracture gradient for a formation may be calculated from the instantaneous shut-in pressure ("ISIP"). The ISIP is an instant pressure reading obtained when the operator pumps a fluid at a desired rate then abruptly decreases the pump rate to zero and instantaneously reads the pump pressure. The pressure reading at zero pump rate is the ISIP.

In relatively thin formations that are fairly homogeneous, the above referenced standard fracturing technique will normally produce a fracture or fractures throughout the depth of the formation. However, when an operator attempts to fracture a large formation having multiple zones of varying stresses and different fracture gradients in a normal fracture treatment, the fracture fluid tends to dissipate only into those portions of the formation having the lowest fracture gradient and the lowest stress gradient. Thus, the fracture treatment may only be effective in a small portion of the overall target formation.

Therefore, operators and service companies in the oil and gas industry have the common problem of finding an economical, innovative, simple solution to stimulate an entire lateral section of a horizontal well effectively. This problem exists for both cemented and un-cemented lateral sections of an oil or gas well. Referring to FIG. 1, a horizontal well is shown with steel casing 100 inserted through a target formation. The steel casing 100 may or may nor have cement between the outside of the casing 100 and the formation. The horizontal well 100 has a lateral section 102 with a heel 104 and toe 106. At certain points in the casing, perforations 108 are formed through the casing using techniques known in the art. These perforations 108 are formed near targeted production zones of the formation, and the perforations 108 allow the hydrocarbons to pass from the formation into the casing 100.

Various analysis techniques, such as radioactive tracer logs, micro-seismic monitoring, and tilt-meter technology, have revealed that the lateral's "mid-section", whether the lateral is 500-ft. in length or longer, is typically "under-stimulated." The various analysis techniques show a trend that up to about 80% of a treatment fluid is only pumped into the rock or formations located at the heel 104 and toe 106 of the lateral section 102. Thus, one problem with treating a long lateral of a horizontal well is that the treatment fluid tends to go in only certain portions of the rock having the lowest stress gradients, leaving much of the production un-stimulated. This is currently seen in horizontal wells in the Barnett Shale. In other words, the majority of a stimulation treatment, such as a fracture treatment on the lateral well, will not reach the productive rock 110 near the middle of the lateral section 102. This phenomenon can economically hurt operators, who expend considerable amounts of time and money to drill and stimulate the horizontal well. Namely, the operators are unable to tap amounts of production and reserves left in the under-stimulated formations.

This phenomenon (i.e., the "80% Heel-Toe" phenomenon) occurs because most horizontal wells are drilled through rock formations that have varying stress gradients and varying rock properties (such as permeability and porosity). The stress gradient of a rock corresponds to how easily the rock can be fractured and how readily the rock can receive a treatment fluid to stimulate the rock. In general, stimulation fluid flows to the path of least resistance (e.g., the rock formation with the lowest stress gradient). For example, if a well has perforations near rock formations with multiple stress gradients, the stimulation fluid flows into the rock formations having the lowest stress gradient. The rock formations having the higher stress gradient may only take part of the stimulation fluid or may not take any stimulation fluid at all.

In one prior art solution, operators and service companies overcome this "80% Heel-Toe" phenomenon by mechanically dividing a horizontal well's lateral into stages. For example, operators set mechanical bridge plugs in the well to shorten the length of the lateral section and to divide the treatment with stimulation fluid into steps or stages. Mechanically dividing the lateral section with bridge plugs allows the operators to better stimulate all the rock formations. However, dividing a well into stages with mechanical bridge plugs costs the operator more time (up to twice as long) and much more money (about 75% more). In addition, the use of mechanical bridge plugs also increases the potential for mechanical failures.

Some horizontal wells contain lateral sections that have the steel casing cemented into the rock (i.e., the cement is positioned between the outside of the steel casing and the rock). For a cemented lateral, the "80% Heel-Toe" phenomenon during stimulation treatment can be overcome by using ball sealers (rubber coated or degradable) as diverting agents. In this prior art solution, the ball sealers are pumped into the casing and become seated in perforations of the casing taking fluid. As has been shown, the ball sealers typically become seated in perforations located at the heel 104 and toe 106 or near rock formations having the lowest stress gradients. When seated, the ball sealers divert the stimulation fluid and change the fluid's path. The treatment fluid is then forced to the perforations with the rock of higher stress gradients or in the mid-section of the lateral. This method of treating cemented laterals has proven effective in many areas by eliminating the costly need of multiple mechanical stages.

A limitation of ball sealers is that they are successful in diversion only when the casing of a well is surrounded by cement with respect to the rock. Namely, other horizontal wells contain steel casing that is un-cemented with the rock. If ball sealers are used to divert the fluid, the treatment fluid can still travel its original path to the rock formations with the lowest stress gradient behind the casing because there is no cement to change the fluid's course when the perforations are sealed closed with ball sealers. Thus, in cases where a well is not cemented in the "target" rock, ball sealers are ineffective and a waste of money and time.

It is known in the art to pump a diverting agent, such as sand plugs into wells. The diverting agent diverts the treatment fluid behind the casing in the formation. For example, one option is to pump sand plugs in with a treatment fluid. These sand plugs consist of 100-mesh grains or other small sizes. This practice can also create diversion in the rock outside the casing. However, in a naturally fractured formation, the sand plugs can permanently plug and ultimately damage the conductivity and productivity of a well. The desire is to "temporarily" create a diversion in a treatment fluid without damaging the formation, conductivity, future production, or reserves.

One problem occurring in most fracturing operations is fluid loss from a target formation. A producing formation generally includes horizontal, undulating layers, which can range from several feet to several hundred feet thick. As a fracturing operation proceeds on a vertical well, the fractures can propagate vertically outside of the target zone, which causes fracturing fluid to move into a non-producing areas of the formation that are located above and/or below the producing area of the formation. Total fluid loss is defined as the amount of fracturing fluid lost to the total area of exposed formation of the created fracture and is known in the industry. Fluid loss is preferably controlled; otherwise, the fracture width will not be sufficient to allow proppants to enter the fracture and keep it propped open.

Therefore, additional materials are placed in the fracturing fluid to limit fluid loss. These materials are termed "fluid-loss additives" and are known in the industry. The fluid loss additives are used to prevent a fracturing fluid from prematurely leaking off into the formation by bridging over pores, fissures, etc. The fluid loss additives are typically pumped in concentrations ranging from about 5 to 50-pounds of agent per 1000-gallons of treatment fluid. This translates to about 0.005 to 0.05-pounds of agent per gallon of treatment fluid. Fluid loss additives can be both permanent and degradable. After a stimulation treatment, fluid loss additives either go back into solution, require an additional chemical to breakdown the additive, or can degrade naturally with temperature, if designed properly.

Thus, the oil and gas industry is constantly seeking a solution that would effectively treat an entire lateral section in one stage in as little time as possible, such as one day. The subject matter of the present disclosure is directed to overcoming, or at least reducing the effects of, one or more of the problems set forth above.

SUMMARY OF THE DISCLOSURE

A method of treating a formation includes pumping a degradable diverting agent in a stimulation treatment of the formation. The disclosed method pumps the degradable diverting agent in a lateral section of a well that requires some type of diversion to treat an entire formation containing rock of multiple stresses properly. The lateral section has perforations or openings in a casing. The casing can be cemented or un-cemented. In addition, the disclosed method can be used with an open-hole lateral, which is a lateral section without casing. Treatment fluid with or without a proppant, such as sand slugs, is pumped into the well to induce fractures in the formation near the lateral section. This pumping of treatment fluids is done without mechanically dividing the lateral section with bridge plugs or the like. The treatment fluid is pumped into the well to treat or induce fractures in portions of the formation at the heel and toe of the lateral section. A concentration of degradable diverting agent is then mixed with the treatment fluid, and the treatment fluid along with diverting agent is pumped into the well. The diverting agent is pumped into the portions of the formation having the lowest fracture gradient, such as at the heel and toe of the lateral section. The diverting agent causes the pumped treatment fluid to change its original path (either in the casing/wellbore or in the formation) in order to stimulate rock near the middle of the lateral, which would normally remain under-stimulated. The pumped fluid is at least diverted from the heel and toe of the lateral section by the diverting agent so that portions of the formation adjacent the middle of the lateral section can be treated the pumped treatment fluid.

The foregoing summary is not intended to summarize each potential embodiment or every aspect of the present disclosure.

BRIEF DESCRIPTION OF THE DRAWINGS

The foregoing summary, preferred embodiments, and other aspects of subject matter of the present disclosure will be best understood with reference to a detailed description of specific embodiments, which follows, when read in conjunction with the accompanying drawings, in which:

FIG. 4A is an example of a pump schedule performed with the disclosed method on an un-cemented horizontal well with a degradable diverting agent introduced at the end of the pad stage of treating the formation.

FIG. 5A is another example of a pump schedule performed with the disclosed method on an un-cemented horizontal well with a degradable diverting agent introduced during sand stages of treating the formation.

Figure 1:
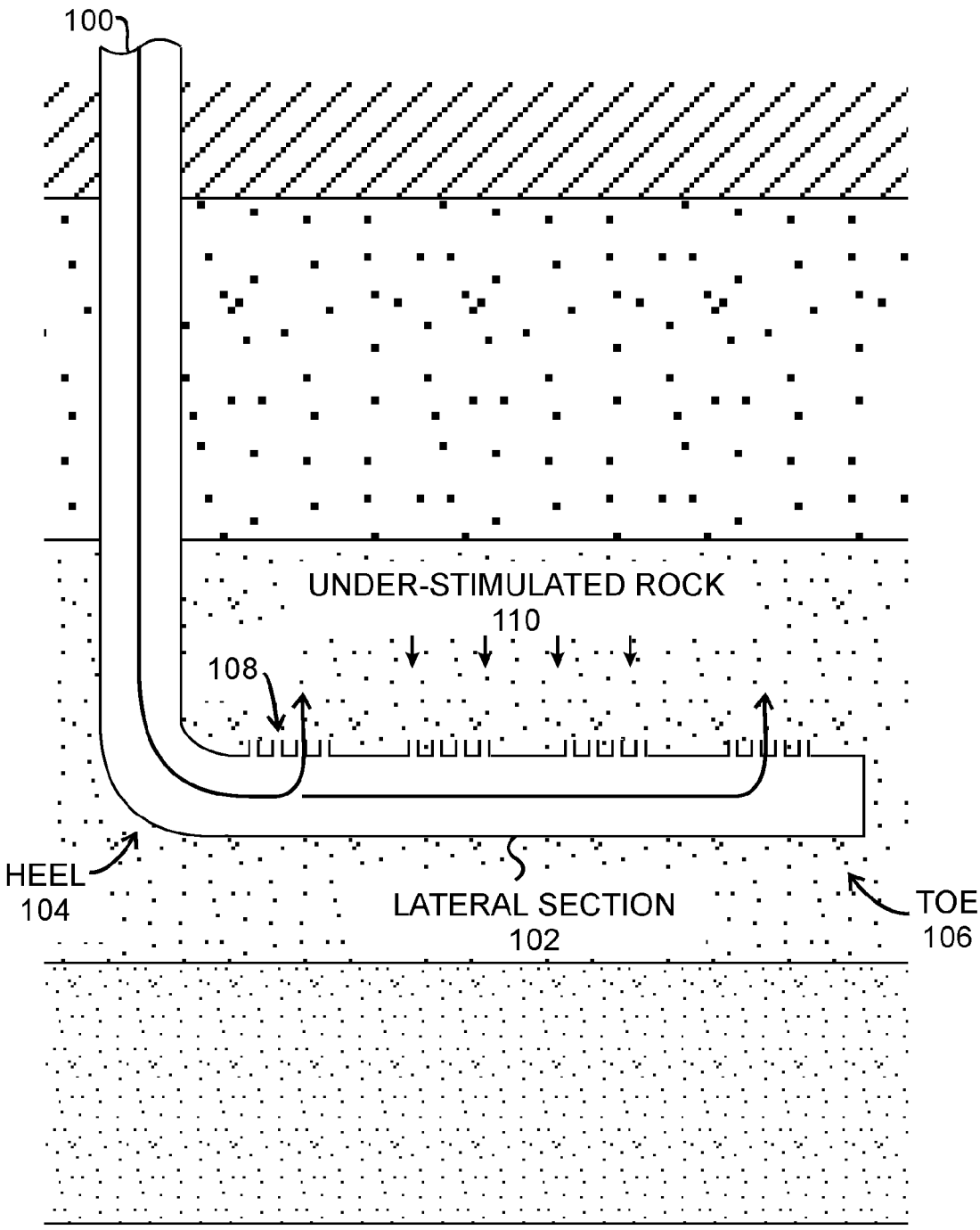
FIG. 1 (Prior Art)
FIG. 1 schematically illustrates a well having a lateral section.

While the disclosed method is susceptible to various modifications and alternative forms, specific embodiments thereof have been shown by way of example in the drawings and are herein described in detail. The figures and written description are not intended to limit the scope of the inventive concepts in any manner. Rather, the figures and written description are provided to illustrate the inventive concepts to a person skilled in the art by reference to particular embodiments, as required by 35 U.S.C. 112.

DETAILED DESCRIPTION

Figure 2:
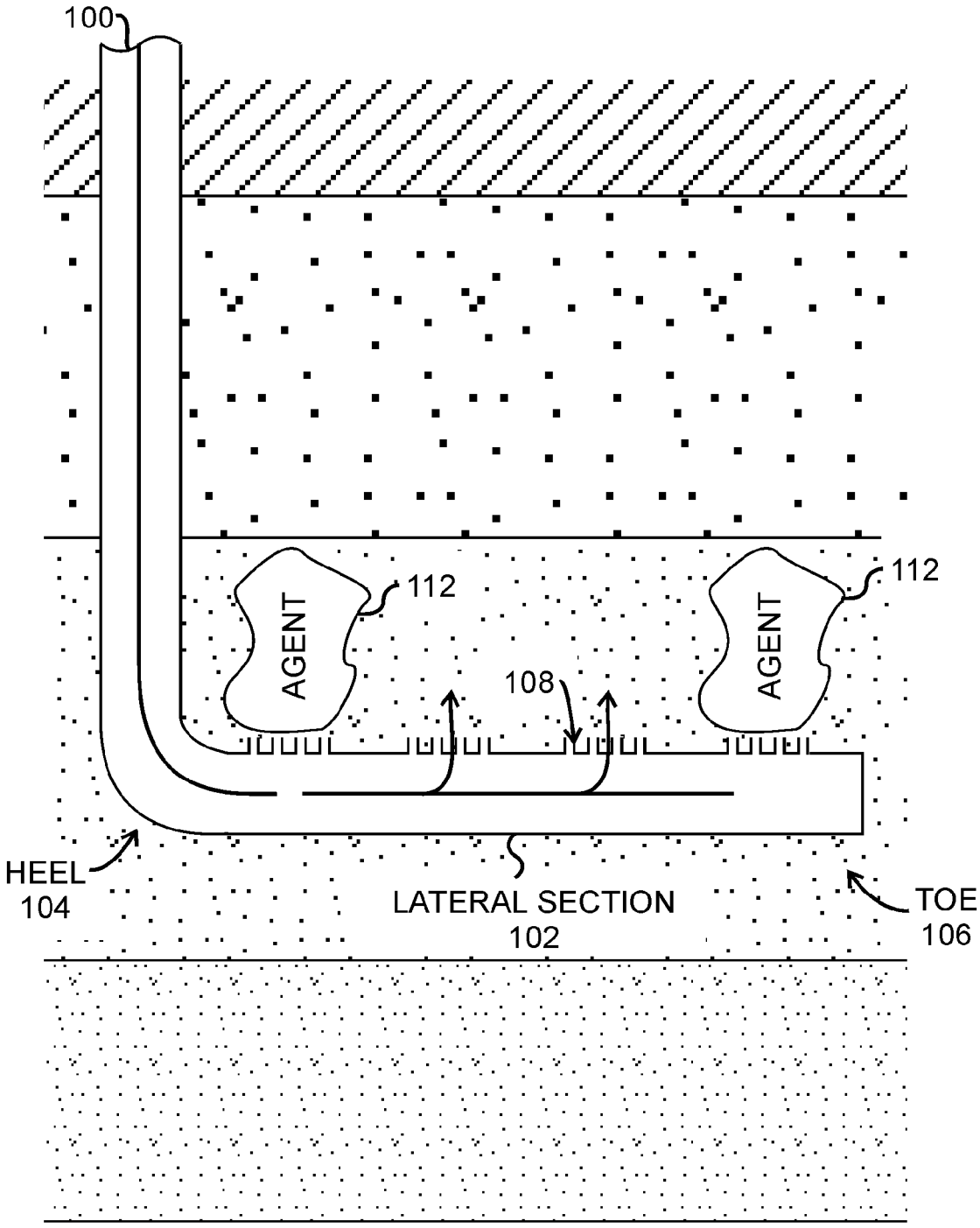
FIG. 2 schematically illustrates the well having the lateral section showing a technique of overcoming the "80% Heel-Toe" phenomenon according to certain teachings of the present disclosure.

Referring to FIG. 2, a portion of a horizontal well is illustrated having a lateral section 102. FIG. 2 schematically shows a method according to certain teachings of the present disclosure for overcoming the "80% Heel-Toe" phenomenon found in lateral section 102. The well is shown with casing 100 inserted through a target formation. The casing 100 is typically made of steel. As is common, the "target" formation has rock with multiple stress gradients so that the formation may not be effectively or wholly treated with a fracture treatment without the use of mechanical stages.

The casing 100 can be either cemented or un-cemented. Although not shown in FIG. 2, the disclosed method can also be used on an open-hole lateral, which is a lateral section of a well without casing. The lateral section 102 has a heel 104 and a toe 106, and perforation clusters or openings 108 are formed in the casing 100. The lateral section 102 can be from 2000 to 5000-ft., for example. The perforation clusters or openings 108 can be pre-formed in the casing 100 before insertion in the well, which is the case for slotted or pre-perforated casings. In addition, the perforation clusters or openings 108 can be formed after the casing 100 is inserted into the well using techniques known in the art. It will be appreciated that the casing 100 can also be a liner, which is any form of casing that does not go to the surface of the well.

As noted in the background section of the present disclosure, a lateral section 102 having a cemented casing 100 typically experiences the "80% Heel-Toe" phenomenon, even when ball sealers are used in the well to seal the perforations 108. As also noted above, ball sealers are ineffective for use on a lateral sections 102 with an un-cemented casing 100 to overcome the "80% Heel-Toe" phenomenon. If the lateral section 102 with un-cemented casing 100 is treated with or without ball sealers and without mechanically separated stages, experience shows that 80% of the fracture treatment would be applied to rock near the heel 104 and toe 106 of the lateral section 102. As a result, the middle portion of the lateral section 102, which can be a significant length, may remain under-treated.

To overcome the problem of the middle portion remaining under-treated, the disclosed method introduces a diverting agent 112 during the fracture treatment. The diverting agent 112 enters the formation at the heel 104 and toe 106 of the lateral section 102 so that treatment fluid is diverted to the middle portion of the lateral section 102. The treatment fluid can be treated water and aqueous-based, nitrogen, carbon dioxide, any acid, diesel, or oil-based fluids, or can be any combination thereof known in the art, for example.

The diverting agent 112 is preferably degradable (e.g., biodegradable, dissolvable, able to melt, etc.) and can be a liquid or solid. The solid diverting agent can be in the form of powder, flakes, granules, pellets, chunks, etc. The pellets for the diverting agent 112 can be 12/20 mesh sized, for example. This solid form of diverting agent is preferably capable of passing through any perforations or openings in the casing and interacting directly with the formation. Thus, the diverting agent is preferably an "in-the-formation" diverting agent as opposed to a ball sealer known in the art. As noted previously, ball sealers typically become seated in perforations or openings of a casing. However, the "in-the-formation" diverting agent used for the disclosed method interacts directly with the formation to divert flow from portions of the formation having lower fracture gradients. Thus, in addition to being used for cemented casings, the "in-the-formation" diverting agent for the disclosed method can be used for un-cemented casings and open-hole laterals where ball sealers prove ineffective.

Although the diverting agent 112 is preferably degradable, the disclosed method can use diverting agents that are not degradable. For example, in the Barnett Shale, a horizontal fracture job monitored micro-seismically from an offset well has revealed that "in-the-formation" diversion occurs in the lateral section when the sand proppant concentration reaches 0.8-pound per gallon (ppg) and greater. In other words, the fracture path of the treatment fluid is altered in the formation when the concentration of sand proppant is at or above 0.8-ppg. Thus, a concentration of a proppant, such as sand, can also be used as a diverting agent according to the method disclosed herein.

Figure 3:
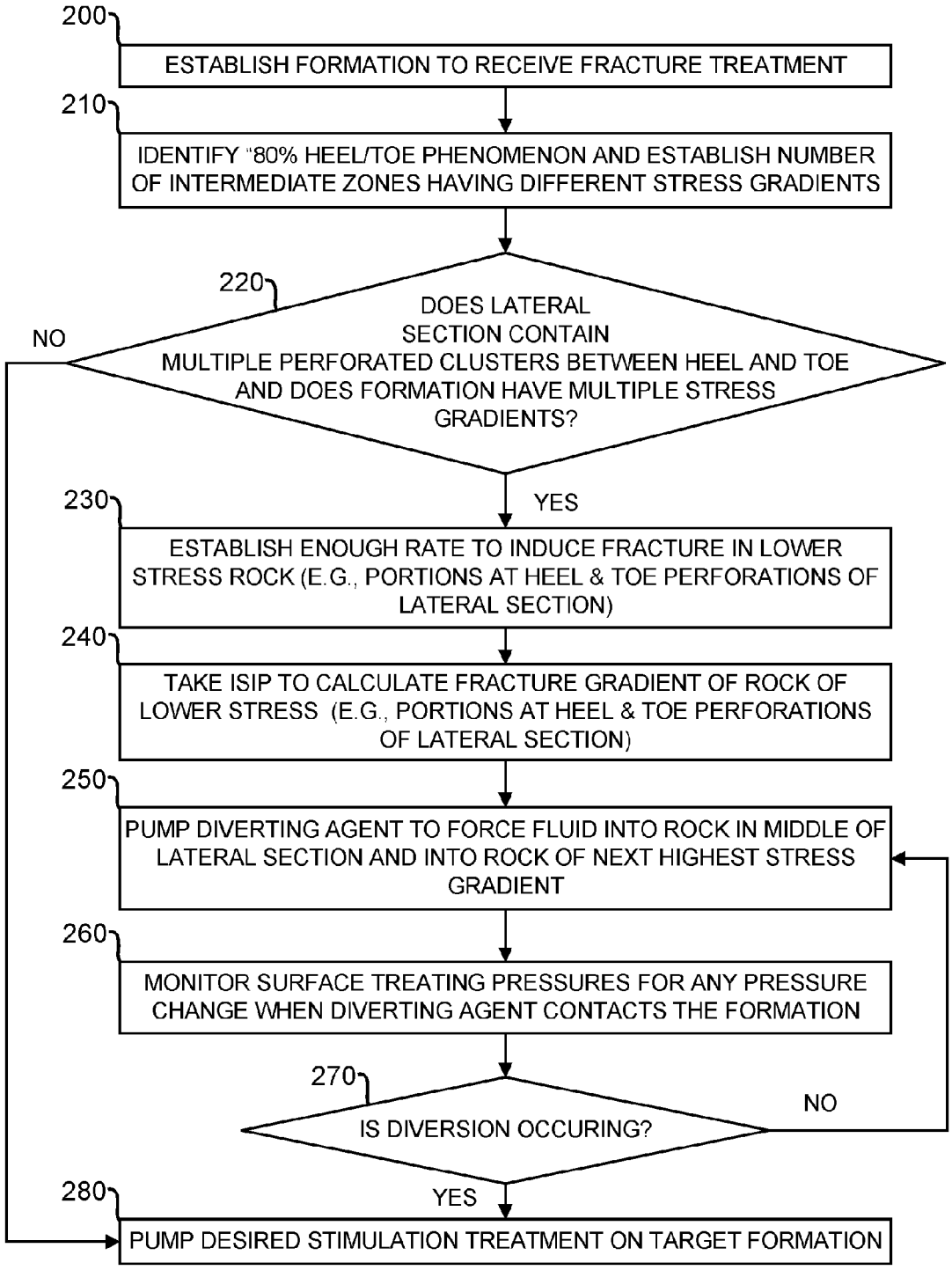
FIG. 3 is a flowchart illustrating steps of the method according to certain teachings of the present disclosure.

Referring to FIG. 3, a flowchart illustrates steps of a method of treating a lateral section of a well according to certain teachings of the present disclosure. The steps do not necessarily have to be performed in the same order as depicted in FIG. 3 to accomplish the objectives of the disclosed method. Once the operator establishes the target formation to the fracture treatment (step 200), the operator identifies the "80% Heel-Toe" phenomenon of a lateral section of the well. In addition, the operator establishes the number of intermediate zones in the lateral section having different stress gradients (step 210). The operator typically determines the number of intermediate zones by reviewing a well log. Although the operator can typically determine how many different intermediate zones exist in a target formation, the operator typically cannot determine the specific rock properties of the formations within the various intermediate zones.

When establishing the number of intermediate zones, the operator determines whether the lateral section contains multiple perforated clusters between the heel and toe of the section (step 220). In addition, the operator determines whether the rock in the lateral section has multiple stress gradients (step 220). If the operator determines that there is only one intermediate zone and/or stress gradient, the operator may skip specific treatments on the lateral section and can proceed directly to the stimulation treatment (step 280).

If the operator determines that there are multiple intermediate zones and/or stress gradients in step 220, the operator initiates step 230-270 and begins a pumping process to prepare the lateral section effectively for stimulation treatment. The operator first establishes a pump rate to induce a fracture in the rock having the lowest stress (step 230). As noted previously, analysis shows that up to 80% of pumped fluid is only pumped into the rock located at the heel and toe of the lateral section. Therefore, the pumped fluid in this step 230 will typically exit the perforations in the heel and toe of the lateral section and will induce fractures in the rock near those areas. The operator then determines the rock properties of the intermediate zone of the lateral section having the lowest rock stress, which will typically coincide with the rock near the heel and toe of the lateral section (step 240). To determine the lowest stress, the operator takes an instant shut in pressure (ISIP) and uses the ISIP to calculate the fracture gradient of the rock.

The disclosed method includes pumping a degradable diverting agent that diverts a treatment fluid's original path temporarily to stimulate the entire, desired producible area of a well effectively (step 250). The operator determines an amount of degradable diverting agent to pump in the well. The degradable diverting agent is pumped into the well and passes through the perforations in the casing adjacent areas of rock with the lowest stress gradient. The disclosed method uses a concentration of degradable solid diverting agent ranging from 0.1-pounds per gallon to infinite pounds per gallon of pumped treatment fluid. Successful diversions have involved concentrations from 3 to 8-pounds of degradable solid diverting agent per gallon of treatment fluid, but the concentration can involve larger or smaller amounts of degradable solid diverting agent. Calculating the concentration of diverting agent to pump into the well is achieved using techniques known in the art and depends on the calculated fracture gradient of the lowest stress.

When pumped, the degradable diverting agent enters the rock with the lowest stress gradient, thereby diverting the pumped fluid. If diverted, the pumped fluid should be forced into rock in the middle portion of the lateral section and into rock having the next highest stress gradient. Hence, the disclosed method can overcome the "80% Heel-Toe" phenomenon observed when stimulating horizontal wells. This step is schematically shown in FIG. 2 where the degradable diverting agent permeates rock at the heel and toe of the lateral section and the pumped fluid is forced against rock in the middle portion of the lateral section. Thus, the diversion actually occurs in the formation and not the casing.

The disclosed method can use any degradable diverting agent suitable for use in horizontal or vertical wells, and the degradable diverting agent can be either liquid or solid. As noted in the background section, additives are used to prevent the loss of fluid from the total area of exposed formation in a well. The fluid loss additives are typically pumped in concentrations ranging from about 5 to 50-pounds of agent per 1000-gallons of treatment fluid. This translates to about 0.005 to 0.05-pounds of agent per gallon of treatment fluid. However, these concentrations are not enough for successful in-the-formation diversion to overcome the "80% Heel-Toe" phenomenon in lateral sections of a well.

For a solid form of degradable diverting agent, the disclosed method involves the concentration of degradable diverting agent ranging from 0.1 to 30,000-pounds of agent per gallon of treatment fluid. On wells having lateral sections, successful concentrations have ranged from 3 to 8-pounds of agent per gallon of treatment fluid. The size or mesh of the solid degradable diverting agent can vary depending on the implementation, area of the formation, and anticipated temperatures. For a liquid form of degradable diverting agent, the disclosed method involves concentrations ranging from 0.5 to 1000-gallons of agent per thousand gallons of treatment fluid.

Preferably, the disclosed method uses a degradable solid diverting agent, which is preferably ground degradable ball sealers, to divest fluid into the zones of higher stress gradients. The ground, degradable ball sealers can be similar to BioBalls available from Santrol and similar to the associated fluid loss additive disclosed in U.S. Pat. No. 6,380,138, which is incorporated herein by reference in its entirety.

While pumping the diverting agent, the operator monitors the surface treating pressure for any pressure changes as the diverting agent contacts the formation (step 260). A pressure change is indicative of diversion of the pumped fluid. Thus, the operator determines whether diversion is occurring (step 270). It should be noted that pumping the degradable diverting agent is preferably timed with the agent's dissolving capacity throughout a large one-stage stimulation treatment on the lateral. The agent's dissolving capacity is typically determined by the temperature of the rock in the target reservoir. In one example, the temperature may be about 200-degrees Fahrenheit. Under typical conditions, the diverting agent is expected to dissolve within about 2-½ hours. If diversion is occurring (e.g., enough diverting agent has been pumped into rock with lowest stress and the pumped fluid is diverted to areas of the middle portion of the lateral section), the operator then begins pumping the desired stimulation treatment on the target formation (step 280). If diversion is not occurring at step 270, the operator repeats the step 250 through 270 to divert the pumped fluid from the rock having the lowest stress.

Referring to FIG. 4A, an example of a pump schedule performed with the disclosed method on an un-cemented horizontal well is illustrated. This example shows the use of a degradable diverting agent introduced at the end of the pad stages of treating the formation in the Barnett Shale. The schedule includes the following columns: stage; gallons of treatment fluid; fluid type along with the mesh and type of proppant; pump rate (bpm); total pounds of proppant during the stage; slurry barrels; and the time interval of the stage. In this and other examples of the present disclosure, the equipment (tanks, pumps, blenders, etc.) and other details for performing the stages are known in the art and are not described for simplicity. In this and other examples of the present disclosure, the type of treatment fluid is treated water, and the proppant includes sand slugs of Ottawa sand. It is understood that a variety of treatment fluids and proppants could be used.

To describe the arrangement of equipment briefly, the fracture operation of FIG. 4A has two banks or crews of equipment for pumping at a rate of 70-bpm each. Transfer pumps are used for water-tank transfer, and back-up downhole blenders are used. Two sides of five working tanks for a total of ten are used for pumping water from a pit to both sets of blenders. The operator pumps 2-ppg and 3-ppg slugs of 40/70 mesh sized Ottawa sand after reaching 400,000 gallons in the pad stage to overcome near-wellbore friction and tortuosity, as known in the art. The operator also pumps a slug of degradable diverting agent with blender screws operating at 200-rpms at least for formation "bridge-off".

To begin the fracture operation, the operator loads the well by pumping 15,000-gallons of treated water into the casing at a rate of 60-bpm. In a pad stage, the operator raises the rate to 130-bpm and holds the rate constant while pumping about 80,000-gallons of treated water. At that point, the operator steps the rate down to zero and reads the ISIP. The operator then determines the number of open holes in the zone having the least stress, the Tortuosity, and the fracture gradient using methods known in the art.

As is known in the art, the operator decreases the rate in steps to a lower rate and holds the rate constant for at least 60 seconds to allow the "water hammer" to subside. A water hammer is a fluctuation in the surface treating pressure (STP) that occurred with any sudden increase or decrease in a fluid's pump rate. If unaccounted for, the water hammer can affect other calculations. The pump pressure should stabilize ("flat line") during the step. If the pump pressure increases or if the operator computes friction pressure and Tortuosity to be greater than 1000-psi, then the operator should shut down the process and re-perforate the casing. Each step's rate and corresponding Net Pressure and Bottomhole Pressure are recorded. When the pump rate equals zero, the ISIP is read and can be used to calculate the fracture gradient, perforation friction, wellbore friction and tortuosity using methods known in the art.

Once the ISIP is read and the number of open holes is computed, the operator performs a series of pad stages. In the present example, these pad stages include pumping (1) 400,000 gallons of treated water into the casing at 130-bpm, and (2) 30,000-gallons of treated water into the casing at 130-bpm along with 63,000-lbs. of sand slugs of 40/70 mesh sized Ottawa sand. Although the present example uses sand slugs as proppants, it should be noted that the use of any proppant is not strictly necessary. After these pad stages, the operator performs an addition pad stage (3) to divert the pumped fluid from the rock having the least stress (e.g., the heel and toe of the lateral section). In this stage, the operator pumps approximately 80,000-gallons of treated water into the casing at 130-bpm along with a concentration of degradable diverting agent. As noted previously, the operator monitors the surface treating pressure for any pressure changes as the diverting agent contacts the formation to determine if diversion is occurring.

After introducing the diverting agent, the operator performs a series of treatment stages to induce fractures in other portions of the lateral section having higher stresses or fracture gradients. In the present example, the stages include pumping various amounts of treated water and concentrations of Ottawa sand at 140-bpm. It is preferred that the pumps are not shut down between stages. This is due mainly to the fact that shutting down when treating a horizontal well is undesirable because it may be difficult to restart the fracture treatment. After completing the treatment, the operator performs an Over-Flush stage by pumping 9,000-gallons of Treated Water at 140-bpm.

Figure 4B:
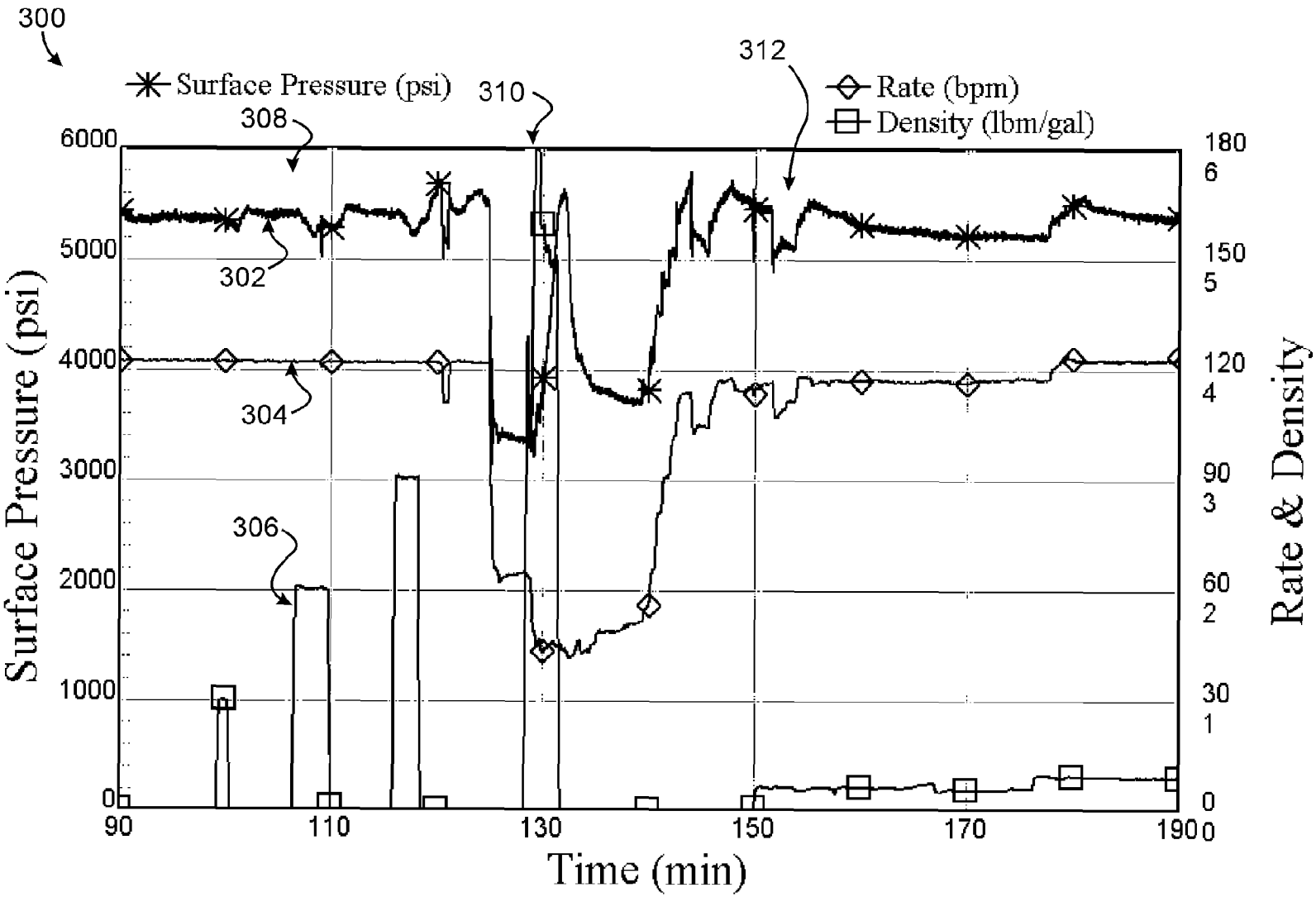
FIG. 4B is a plot corresponding to the example pump schedule of FIG. 4A in which surface pressure, density, and pump rate are measured against time.

FIG. 4B is a plot 300 showing surface pressure, density, and pump rate measured against time for a portion of the example fracture operation in the pump schedule of FIG. 4A. The interval of the plot 300 corresponds to the time around the pad stage of pumping 80,000-gallons of treated water into the casing at 130-bpm along with a concentration of degradable diverting agent. Line 302 indicates the measured surface pressure (psi) as a function of time, line 304 indicates the pump rate (bpm) as a function of time, and line 306 indicates the density (lb/gal) as a function of time. The pad stage when the diverting agent is introduced is labeled as 310 and precedes an earlier pad stage labeled 308. The point in time when the fracture stages are started is labeled as 312.

Referring to FIG. 5A, another example of a pump schedule performed with the disclosed method on an un-cemented horizontal well is illustrated. As before, the pump schedule is exemplary and has similar columns, treated water, and sand slug proppants. In contrast to the previous example, however, this example shows the use of a degradable diverting agent introduced during fracture stages of treating the formation, which is preferred.

To describe the arrangement of equipment briefly, the fracture operation of FIG. 5A has two banks or crews of equipment for pumping at a rate of 65 bpm each. Transfer pumps are used for water-tank transfer, and back-up downhole blenders are used. Two sides of five working tanks for a total of ten are used for pumping water from a pit to both sets of blenders. The operator pumps 2-ppg Slugs of 40/70 Ottawa sand after 360,000 gallons in a pad stage to overcome near-wellbore friction and tortuosity, as known in the art. The operator also pumps a 5000-lb. slug of degradable diverting agent with blender screws operating at 200 rpms at least for formation "bridge-off" in the 0.6-ppg stage. For this, the operator keeps the rate constant if the surface treating pressure is less than 5400-psi. The fracture job is radioactively traced throughout pumping, and 40/70 Ottawa sand is pumped before and after the degradable diverting agent is introduced in the 0.6-ppg stage.

To begin the fracture operation, the operator loads the well by pumping 15,000-gallons of treated water into the casing at a rate of 60-bpm. In a pad stage, the operator raises the rate to 125-bpm and holds the rate constant while pumping about 80,000-gallons of treated water. At that point, the operator steps the rate down to zero and reads the ISIP. The operator then determines the number of open holes in the zone having the least stress, the Tortuosity, and the fracture gradient using methods known in the art.

Once the ISIP is read and the number of open holes are computed, the operator performs another pad stages by pumping 360,000-gallons of treated water into the casing at 125-bpm. Subsequently, the operator performs a series of fracture stages having various concentrations and amounts of treated water and sand slugs of Ottawa at rates of about 130-bpm. Although the present example uses sand slugs, it should be noted that this is not strictly necessary. About mid point in these fracture stages, the operator performs an addition pad stage to divert the pumped fluid form the rock having the least stress (e.g., the heel and toe of the lateral section). In this stage, the operator pumps approximately 9,000-gallons of treated water into the casing at 130-bpm along with a concentration of degradable diverting agent. As noted previously, the operator monitors the surface treating pressure for any pressure changes as the diverting agent contacts the formation to determine if diversion is occurring. After introducing the diverting agent, the operator continues to perform a series of fracture stages having various concentrations and amounts of treated water and sand concentrations to induce fractures in other portions of the lateral section having higher stresses or fracture gradients. After completing the treatment, the operator performs an Over-Flush stage.

Figure 5B:
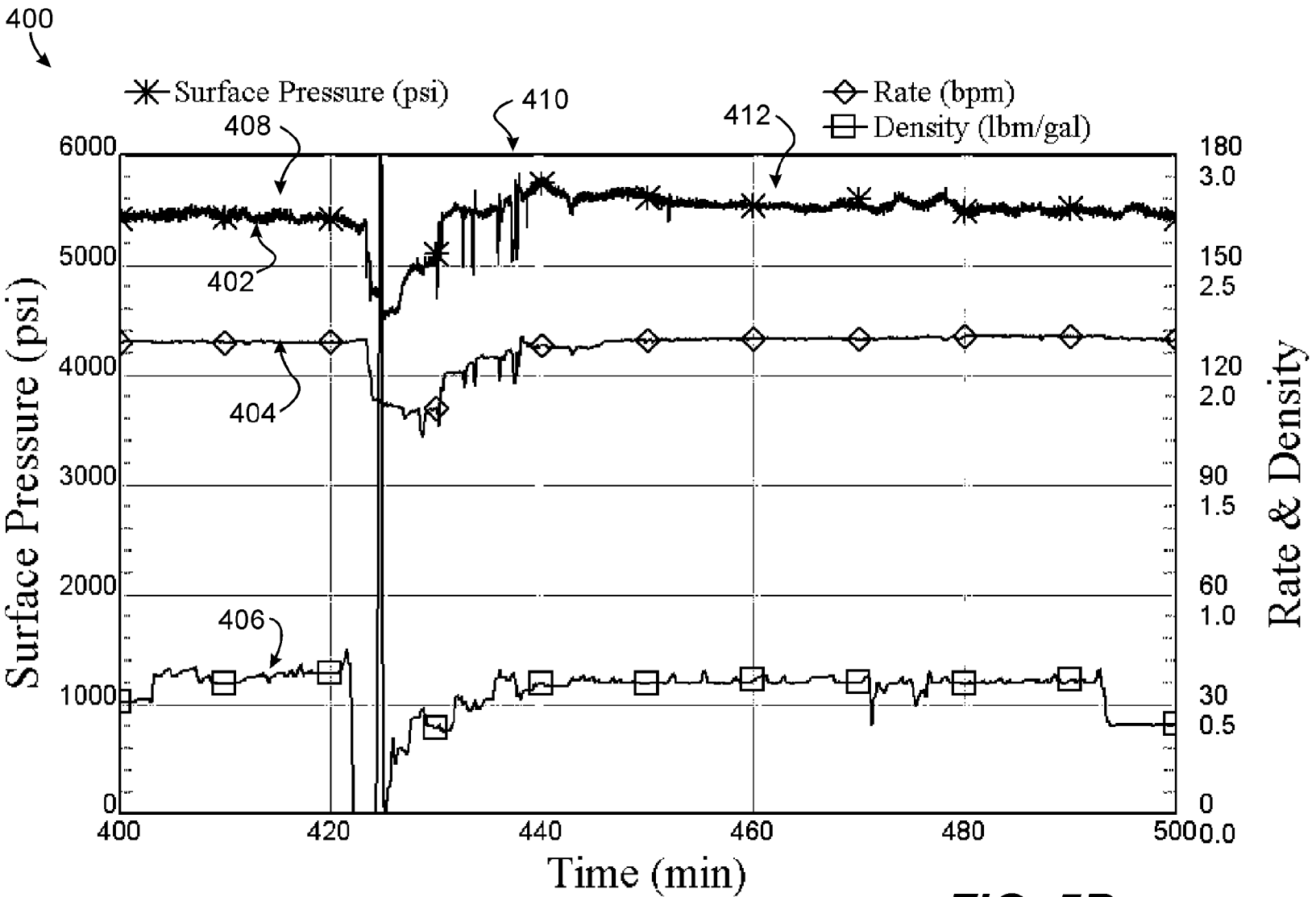
FIG. 5B is a plot corresponding to the example pump schedule of FIG. 5A in which surface pressure, density, and pump rate are measured against time.

FIG. 5B is a plot 400 showing surface pressure, density, and pump rate measured against time for a portion of the example fracture operation in the pump schedule of FIG. 5A. The interval of the plot 400 corresponds to the time around the pad stage of pumping 9,000-gallons of treated water into the casing at 130-bpm along with a concentration of degradable diverting agent. Line 402 indicates the measured surface pressure (psi) as a function of time, line 404 indicates the pump rate (bpm) as a function of time, and line 406 indicates the density (lb/gal) as a function of time. The pad stage when the diverting agent is introduced is labeled as 410. This stage 410 occurs between fracture stages of 0.6-ppg 40/70 mesh sized Ottawa sand labeled as 408 and 412.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of treating a formation at a lateral section of a horizontal well, the lateral section having a heel, a middle, and a toe, the method comprising:

pumping treatment fluid into the well such that the treatment fluid interacts with portions of the formation at the heel and toe of the lateral section;

treating portions of the formation at the heel and toe of the lateral section with the pumped treatment fluid;

calculating a fracture gradient representative of portions of the formation at the heel and toe of the lateral section;

calculating a concentration of diverting agent to use with the treatment fluid based on the calculated fracture gradient;

combining the concentration of diverting agent with treatment fluid;

pumping treatment fluid with the concentration of diverting agent into the well such that the pumped treatment fluid is diverted from portions at the heel and toe of the lateral section by the diverting agent; and treating portions of the formation at the middle of the lateral section with the diverted treatment fluid.

2. The method of claim 1, wherein the lateral section of the well comprises a cemented casing, an un-cemented casing, or an open-hole lateral.

3. The method of claim 1, wherein the diverting agent comprises a solid selected from the group consisting of powder, flakes, granules, pellets, and chunks.

4. The method of claim 3, wherein the concentration of the solid diverting agent is about 3 to 8 pounds of the solid diverting agent per gallon of treatment fluid.

5. The method of claim 1, wherein the diverting agent comprises a liquid, and wherein the concentration of the liquid diverting agent is about 0.5 to 1000-gallons of the liquid diverting agent per thousand gallons of treatment fluid.

6. The method of claim 1, wherein the act of pumping treatment fluid into the well such that the treatment fluid interacts with portions of the formation at the heel and toe of the lateral section through openings in the casing comprises pumping treatment fluid without mechanically dividing the lateral section.

7. The method of claim 1, wherein the act of pumping treatment fluid further comprises combining a proppant with the treatment fluid for pumping into the well.

8. The method of claim 1, wherein the diverting agent comprises a degradable diverting agent.

9. The method of claim 1, wherein the act of pumping treatment fluid with the concentration of diverting agent into the well further comprises monitoring a surface treating pressure for a pressure changes indicative of diverting agent contacting portions of the formation to determine if diversion is occurring.

10. A method of treating a formation at a lateral section of a horizontal well, the lateral section having a casing with openings and having a heel, a middle, and a toe, the method comprising:

pumping treatment fluid into the well such that the treatment fluid interacts with portions of the formation at the heel and toe of the lateral section;

treating portions of the formation at the heel and toe with the pumped treatment fluid interacting with the portions of the formation at the heel and toe of the lateral section through openings in the casing;

calculating a fracture gradient representative of portions of the formation at the heel and toe of the lateral section;

calculating a concentration of diverting agent to use with treatment fluid based on the calculated fracture gradient and a number of openings at the portions of the formation at the heel and toe of the lateral section;

combining the concentration of diverting agent with treatment fluid, the diverting agent configured to pass through the openings of the casing in the lateral section to interact directly with the formation;

pumping treatment fluid with the concentration of diverting agent into the well such that the pumped diverting agent passes through the openings of the casing in the lateral section and interacts directly with portions at the heel and toe of the lateral section and such that the pumped treatment fluid is diverted from the portions of the heel and toe of the lateral section by the diverting agent interacting directly with the portions of the formation; and treating portions of the formation at the middle of the lateral section with the diverted treatment fluid interacting with the portions of the formation at the middle of the lateral section through openings in the casing.

11. The method of claim 10, wherein the casing comprises a cemented casing or an un-cemented casing.

12. The method of claim 10, wherein the act of pumping treatment fluid into the well such that the treatment fluid interacts with portions of the formation at the heel and toe of the lateral section comprises pumping the treatment fluid into the well without mechanically dividing the lateral section.

13. The method of claim 10, wherein the diverting agent comprises a solid selected from the group consisting of powder, flakes, granules, pellets, and chunks.

14. The method of claim 13, wherein the concentration of the solid diverting agent is about 3 to 8 pounds of the solid diverting agent per gallon of treatment fluid.

15. The method of claim 10, wherein the diverting agent comprises a liquid, and wherein the concentration of the liquid diverting agent is about 0.5 to 1000-gallons of the liquid diverting agent per thousand gallons of treatment fluid.

16. The method of claim 10, wherein the act of pumping treatment fluid further comprises combining a proppant with the treatment fluid for pumping into the well.

17. The method of claim 10, wherein the diverting agent comprises a degradable diverting agent.

18. The method of claim 10, wherein the act of pumping treatment fluid with the concentration of diverting agent into the well further comprises monitoring a surface treating pressure for a pressure changes indicative of diverting agent contacting portions of the formation to determine if diversion is occurring.

19. A method of treating a formation at a lateral section of a horizontal well, the lateral section having an un-cemented casing with openings and having a heel, a middle, and a toe, the method comprising:

pumping treatment fluid into the well without mechanically dividing the lateral section;

inducing fractures in portions of the formation at the heel and toe with the pumped treatment fluid interacting with the portions of the formation at the heel and toe of the lateral section through openings in the un-cemented casing;

calculating a fracture gradient representative of portions of the formation at the heel and toe of the lateral section;

calculating a concentration of in-the-formation diverting agent to use with treatment fluid based on the calculated fracture gradient and a number of openings at portions of the formation at the heel and toe of the lateral section;

combining the concentration of in-the-formation diverting agent with treatment fluid, wherein the in-the-formation diverting agent is capable of passing through the openings in the un-cemented casing;

pumping treatment fluid with the concentration of in-the-formation diverting agent into the well such that the pumped treatment fluid is diverted from portions at the heel and toe of the lateral section by the in-the-formation diverting agent interacting directly with the portions of the formation; and inducing fractures in portions of the formation at the middle of the lateral section with the diverted treatment fluid interacting with portions of the formation at the middle of the lateral section through openings in the un-cemented casing.

20. The method of claim 19, wherein the in-the-formation diverting agent comprises a solid selected from the group consisting of powder, flakes, granules, pellets, and chunks.

21. The method of claim 20, wherein the concentration of the solid diverting agent is about 3 to 8 pounds of the solid diverting agent per gallon of treatment fluid.

22. The method of claim 19, wherein the in-the-formation diverting agent comprises a liquid, and wherein the concentration of the liquid diverting agent is about 0.5 to 1000-gallons of the liquid diverting agent per thousand gallons of treatment fluid.

23. The method of claim 19, wherein the act of pumping treatment fluid further comprises combining a proppant with the treatment fluid for pumping into the well.

24. The method of claim 19, wherein the in-the-formation diverting agent comprises a degradable diverting agent.

25. The method of claim 19, wherein the act of pumping treatment fluid with the concentration of diverting agent into the well further comprises monitoring a surface treating pressure for a pressure changes indicative of in-the-formation diverting agent contacting portions of the formation to determine if diversion is occurring.

* * * * *